US009157301B2

(12) United States Patent
Blankenship

(10) Patent No.: US 9,157,301 B2
(45) Date of Patent: Oct. 13, 2015

(54) MODULAR TOP LOADING DOWNHOLE PUMP

(71) Applicant: Samson Pump Company, LLC, Porter, OK (US)

(72) Inventor: Howard Blankenship, Red Oak, OK (US)

(73) Assignee: Samson Pump Company, LLC, Porter, OK (US)

( * ) Notice: Subject to any disclaimer, the term of this patent is extended or adjusted under 35 U.S.C. 154(b) by 244 days.

(21) Appl. No.: 13/773,826

(22) Filed: Feb. 22, 2013

(65) Prior Publication Data

US 2014/0238688 A1 Aug. 28, 2014

(51) Int. Cl.
*E21B 43/12* (2006.01)
*E21B 34/06* (2006.01)

(52) U.S. Cl.
CPC ..... *E21B 43/121* (2013.01); *E21B 34/063* (2013.01); *E21B 43/12* (2013.01)

(58) Field of Classification Search
CPC ..... E21B 34/08; E21B 43/123; E21B 43/129; E21B 43/121; F04B 47/12
See application file for complete search history.

(56) References Cited

U.S. PATENT DOCUMENTS

| | | | | |
|---|---|---|---|---|
| 1,578,720 | A | 3/1926 | Derby | |
| 2,146,328 | A * | 2/1939 | Collins | 417/503 |
| 2,688,928 | A * | 9/1954 | Vincent et al. | 92/43 |
| 2,704,980 | A * | 3/1955 | Vincent | 417/59 |
| 3,046,904 | A | 7/1962 | Crow | |
| 3,090,316 | A * | 5/1963 | Montgomery | 166/372 |
| 3,773,437 | A | 11/1973 | Suman, Jr. | |
| 3,861,471 | A | 1/1975 | Douglas | |
| 4,211,279 | A * | 7/1980 | Isaacks | 166/64 |
| 4,386,653 | A | 6/1983 | Drake | |
| 4,410,038 | A * | 10/1983 | Drapp | 166/53 |
| 4,643,258 | A | 2/1987 | Kime | |
| 4,741,679 | A | 5/1988 | Blassingame | |
| 4,968,226 | A | 11/1990 | Brewer | |
| 5,104,301 | A | 4/1992 | Brewer | |
| 5,249,936 | A | 10/1993 | McConnell et al. | |
| 5,915,478 | A * | 6/1999 | Brown et al. | 166/329 |
| 6,273,690 | B1 | 8/2001 | Fischer et al. | |
| 6,322,616 | B1 | 11/2001 | Kennedy et al. | |
| 6,651,740 | B2 | 11/2003 | Kobylinski et al. | |
| 6,886,636 | B2 | 5/2005 | Michael et al. | |
| 6,945,762 | B2 | 9/2005 | Williams | |
| 7,458,787 | B2 | 12/2008 | Brown | |
| 7,506,690 | B2 * | 3/2009 | Kelley | 166/372 |
| 7,604,464 | B2 | 10/2009 | Williams | |
| 8,122,966 | B2 * | 2/2012 | Kelley | 166/372 |
| 8,303,272 | B2 | 11/2012 | Pugh et al. | |
| 2005/0053503 | A1 | 3/2005 | Gallant | |
| 2007/0000663 | A1 * | 1/2007 | Kelley | 166/268 |

(Continued)

*Primary Examiner* — Jennifer H Gay
(74) *Attorney, Agent, or Firm* — Millikin Intellectual Property Law, PLLC

(57) ABSTRACT

A method and apparatus for improving the production efficiency of a well and preventing gas lock. The apparatus is a downhole pump and comprises a barrel, a reciprocating plunger and a body having a plurality of inlet valves. The apparatus does not require outlet valves. The body and inlet valves are positioned above the barrel and plunger, thus eliminating gas lock. Fluids enter the body through the valves and, during upstrokes of the plunger, are forced up the tubing string to the surface equipment. Modularity of the components permits pump components to be changed as the productivity of the well fluctuates and also allows production of more fluids with a smaller casing.

52 Claims, 6 Drawing Sheets

(56) References Cited

U.S. PATENT DOCUMENTS

2008/0240930 A1* 10/2008 Palka et al. ..... 417/42
2008/0247893 A1 10/2008 Perkisn et al.
2010/0147514 A1 6/2010 Swaringin
2010/0252271 A1* 10/2010 Kelley ..... 166/370
2010/0294506 A1* 11/2010 Rodriguez et al. ..... 166/372
2014/0238688 A1* 8/2014 Blankenship ..... 166/369

* cited by examiner

MODULAR TOP LOADING DOWNHOLE PUMP

TECHNICAL FIELD OF THE INVENTION

The present invention relates generally to downhole pumps and, more particularly, but not by way of limitation, to downhole pumps in subterranean wells for moving fluids and slurries to the surface of the earth and for preventing gas lock. Methods of pumping fluids and of preventing gas-lock in downhole pumps are also provided.

SUMMARY OF THE INVENTION

The present invention is directed to a downhole pump positioned below the tubing string of a well for pumping fluids. The pump comprises a body and at least one valve connectable with the body. The at least one valve comprises a first aperture through which fluids enter the at least one valve and a second aperture through which fluids exit the at least one valve and enter the body. The pump comprises a plunger moveable between an upper first position and a lower second position, wherein the upper first position is below the at least one valve. During plunger downstrokes, fluids entering through the first aperture enter the body, and during plunger upstrokes, fluids move up the tubing string.

The present invention is further directed to a system for pumping fluids in a well having a tubing string. The system comprises a pump, the pump comprising a body positioned below the tubing string, a moveable plunger positioned below the body, and at least one valve connectable with the body. The plunger is moveable between an upper first position and a lower second position, wherein the upper first position is below the at least one valve. The at least one valve comprises, a first aperture through which fluids enter the at least one valve and a second aperture through which fluids exit the at least one valve and enter the body. During plunger downstrokes, fluids entering through the first aperture enter the body and during plunger upstrokes, fluids move up the tubing string.

The present invention is further directed to method of pumping fluids from a reservoir via a well comprising a tubing string. The method comprises the steps of intaking fluid into a body via an inlet valve positioned above a plunger within a barrel, moving the plunger between an upper first position and a lower second position, wherein the upper first position is below the inlet valve, and moving the fluid up the tubing string on the upstroke of the plunger.

The present invention is further directed to a method of preventing gas lock in a well comprising a tubing string. The method comprises the steps of intaking fluid via a valve positioned above a plunger within a barrel, moving the plunger between an upper first position and a lower second position, wherein the upper first position is below the valve and discharging fluid from the valve into a body positioned below the tubing string and moving fluid up the tubing string on the upstroke of the plunger.

The present invention further is directed to a component for use with a plunger in a tubing string of a well for pumping fluids, the plunger moveable between an upper first position below the component and a lower second position below the component. The component comprises a body and at least one valve connectable with the body. The at least one valve comprises a first aperture through which fluids enter the at least one valve and a second aperture through which fluids exit the at least one valve and enter the body.

Still further, the invention is directed to a downhole pump positioned below the tubing string of a well for pumping fluids. The pump comprises a body, a barrel positioned below the body, a moveable plunger positioned within the barrel and below the body, wherein the plunger is moveable between an upper first position and a lower second position, wherein the upper first position is below the at least one valve, and at least one valve connectable with the body. The at least one valve comprises a plug, a first aperture through which fluids enter the valve and a second aperture through which fluids exit the valve and enter the body. During plunger downstrokes, fluids entering through the first aperture open the plug and enter the body and wherein during plunger upstrokes, fluids close the plug and are forced from the body up the tubing string.

DETAILED DESCRIPTION OF THE INVENTION

Figure 1:
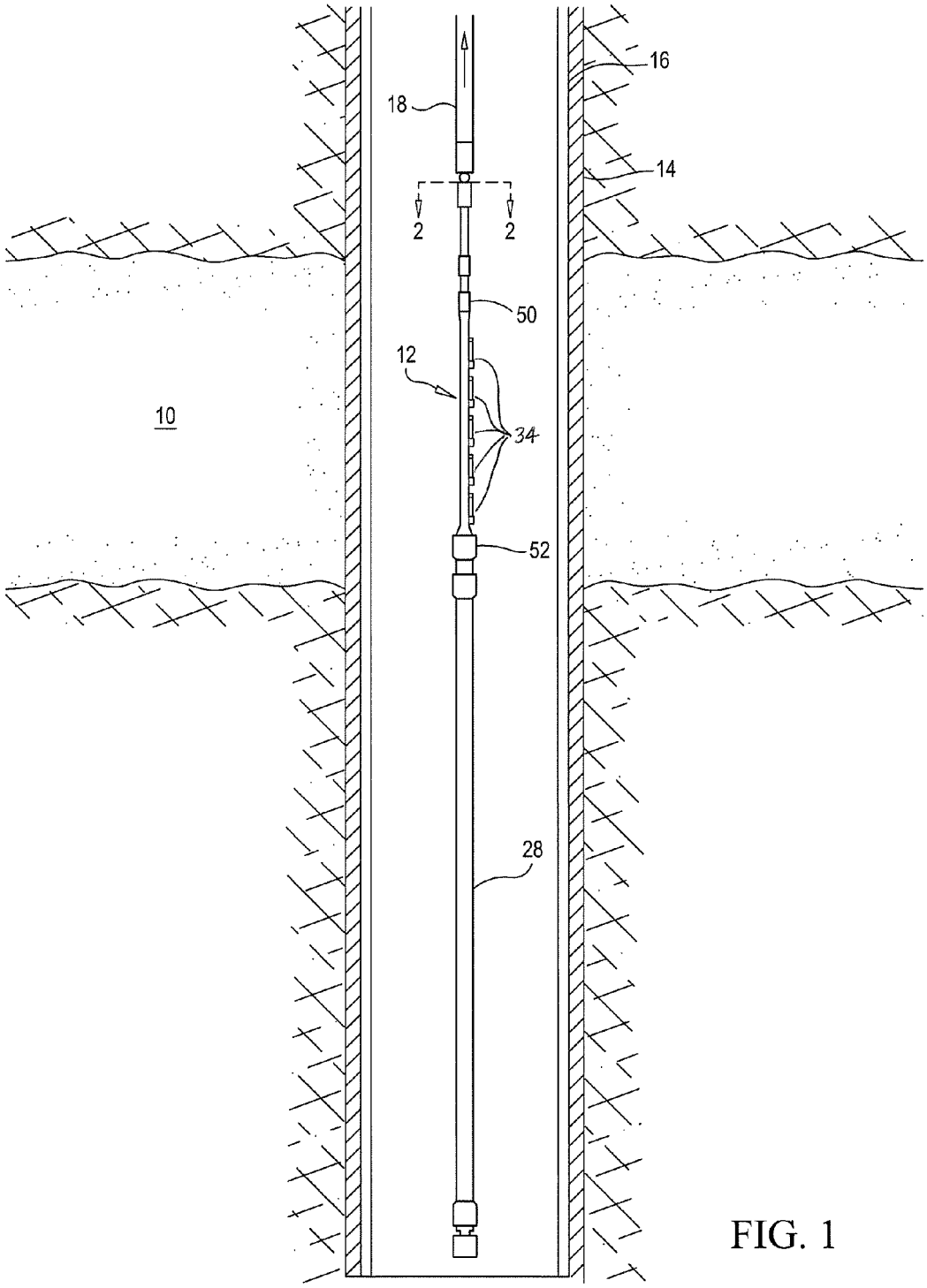
FIG. 1 is a schematic drawing of a borehole illustrating a well bore in which a tubing string is suspended and carries an exemplar of the downhole pump of the present invention.

The task of moving subterranean fluids, including oil, gas and slurries, from a reservoir to the surface of the earth requires a system of equipment that typically includes a downhole pump, often a reciprocating-type positive displacement pump, positioned within the borehole of the well. The downhole pump is connected, directly or indirectly, to a sucker rod string within the tubing in the borehole. The rod string cooperates with an artificial lift unit or pump jack that is powered by a prime mover, such as a combustion engine or electric motor. The sucker rod string moves up and down within the tubing in the borehole via motion of the artificial lift unit and transfers movement to the downhole pump.

Downhole positive displacement pumps of the reciprocating type often have a plunger within a barrel and a series of inlet and outlet valves for receiving and discharging fluid. The barrel is attached to the end of the tubing, and the plunger is attached to the sucker rod string. Reciprocating action of the plunger charges a cavity disposed between the valves and lifts fluids through the tubing to the surface. Fluids flow into the pump through inlet valves on the suction, or up stroke, of the plunger as the cavity is expanding, and they are discharged through outlet valves on the discharge or down stroke as the cavity size decreases. Fluids discharged from the pump are forced up the tubing string to the wellhead where liquids and gases are separated and moved into production streams.

Problems can arise when gases are present. Some wells produce free gas, or gases entrained in liquid will come out of solution during production. These gases may partially fill the cavity of the pump, displacing oil or other more desirable liquids, thereby adversely affecting the efficiency of the well.

Moreover, gases may overtake the cavity of the pump, causing gas lock. Gases trapped between the inlet and outlet valves prevent the pump from achieving sufficient pressure to move fluids up the tubing string. When this happens, all valves are stuck in the closed position holds the ball off seat, preventing fluid from moving through the pump or up the string to the surface. Concomitant losses in productivity occur. Efforts to eliminate gas lock sometimes occasion damage to the equipment and tools in the wellbore.

The downhole pump of the present invention overcomes problems associated with gas lock. Through a unique configuration, the plunger is positioned within a barrel below inlet valves in the pump. Inlet valves cooperate with a body positioned above the plunger and the barrel so that fluids enter the above the plunger and barrel. When the plunger moves up, intake fluids close off the valves and fluids are forced up the tubing string through a conventional slide valve that normally is used to connect the sucker rod string to the valve rod. This configuration eliminates the need for outlet valves and eliminates gas lock.

This configuration allows modularity of the pump components and offers benefits as the productivity of the well changes. An operator easily can alter the size of the barrel and the plunger to match modifications in production. For example, as well productivity decreases, the plunger and barrel can be replaced by smaller units that will pump fewer barrels in a given time period. Alternately, if enhanced recovery techniques cause the well to increase production, the modularity of the pump design of the present invention permits plunger and barrel to be easily interchanged with components matching higher production levels.

The modular design of the present invention also eases maintenance and decreases shut-in times and frequency. It is expected that mechanical parts, especially in moving systems, will break down or require maintenance. The unique configuration enables repair or replacement of valves, plunger, barrel, body and other parts without replacing the entire pump, resulting in lower maintenance costs and more efficient repair and shut-in times. These and other advantages of the present invention will be apparent from the following description of embodiments.

Turning now to the drawings in general, and to FIG. 1 in particular, there is shown therein a schematic of an earth formation 10 in which an exemplary downhole pump 12 of the present invention is shown suspended in a well 14. Casing 16 is cemented in place and serves to support the sides of the well 14. A tubing string 18 is suspended inside the casing 16 for returning fluids to the separation and production equipment at the surface of the well 14 and carries at its lower end the downhole pump 12. While FIG. 1 depicts a vertical well, it will be appreciated that the downhole pump of the present invention is suitable for use in deviated and horizontal wells, as well. Moreover, the downhole pump 12 of the present invention is suitable for use to pump a variety of fluids. As used herein, fluids include gases, oils, vapors, viscous substances, heavy oils, water, slurries, cements and muds.

Figure 2:
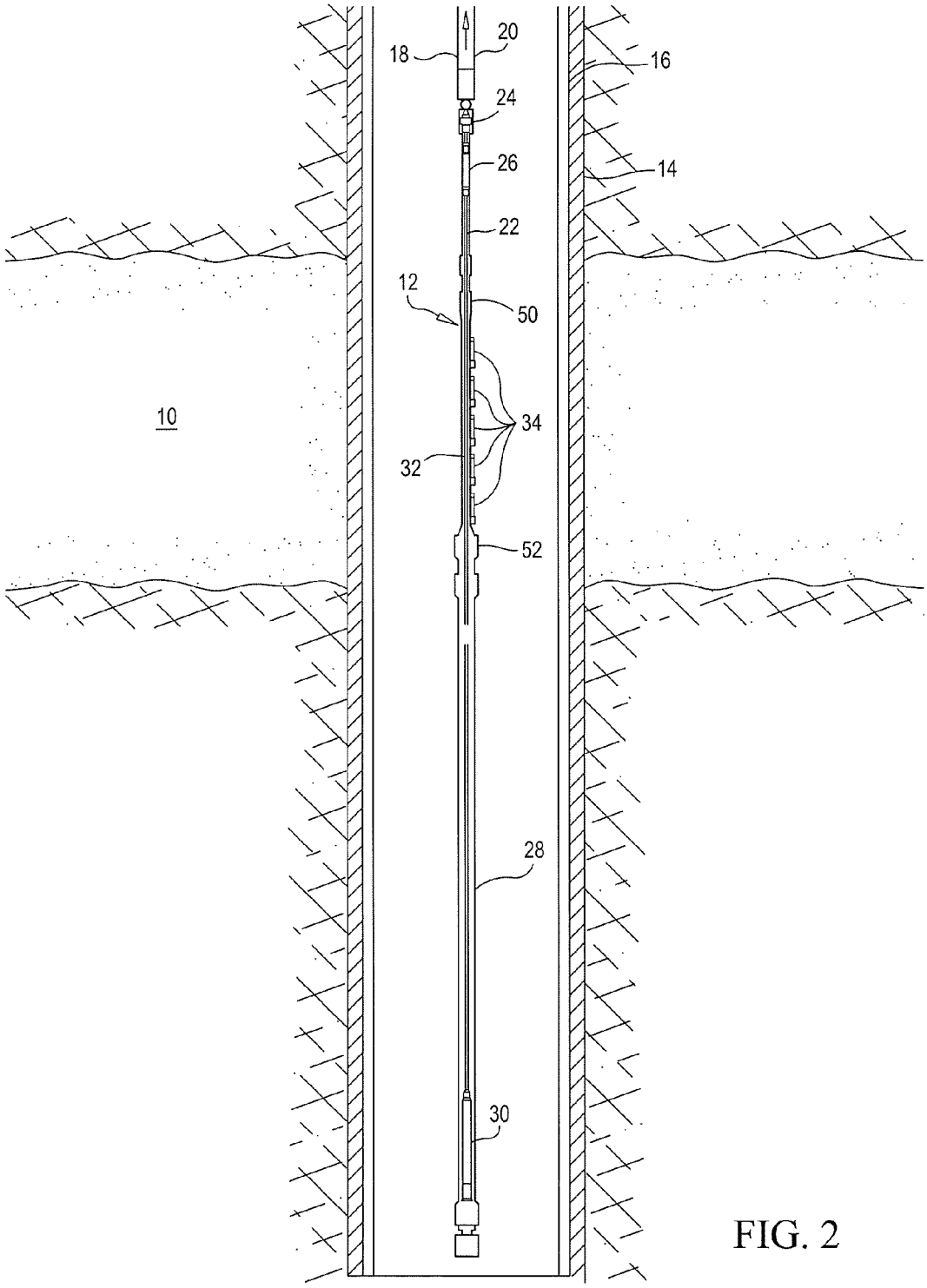
FIG. 2 is a cross-sectional view of the downhole pump of FIG. 1 taken along line 2-2.

Turning now to FIG. 2, there is shown a cross-section of the downhole end of the wellbore 10 of FIG. 1. A sucker rod string 20 connects downhole pump 12 to a pump jack, artificial lift unit or other reciprocating driver at the earth's surface, as is known in the art. Sucker rod string 20 is connected to valve rod 22 via valve rod adapter 24 and slide valve 26. Slide valve 26 is a conventional slide valve known in the art and permits the flow of fluids from the pump 12 into the tubing string 18. As the pump jack moves up and down, the sucker rod string 20 moves valve rod 22, which reciprocate within the pump 12. Fluids enter the pump 12 in a manner yet to be described and move up the tubing string in the direction of arrow x.

With continuing reference to FIGS. 1 and 2, in one embodiment of the present invention, the downhole pump comprises a barrel 28, a plunger 30, a body 32 positioned above the barrel and plunger, and a plurality of valves 34. The barrel 28 may be any conventional barrel and may made be of any material suitable for use downhole, including steel, chrome, steel chrome-plated, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the barrel 28 may be produced from other materials suited to the particular temperatures, pressures, fluids, and other conditions at the well 14 where in use. The diameter and length of the barrel 28 are variable and depend upon the size of the well 14, the diameter of the casing 16, the size and diameter of the plunger 30 and the quantity of production from the well, for example. The length of the barrel 28 generally ranges from at least about 6 to at least about 60 feet, while the diameter of the barrel generally ranges from at least about 1 and 1/16 inches to at least about 7 and 3/4 inches. References herein to diameters are to inside diameters, unless specifically stated to reference an outer diameter. It will be appreciated, however, that the barrel may be any diameter and length suited for conditions at the well where in use. The barrel 28 preferably, though not necessarily, complies with American Petroleum Institute (API) quality standards and dimensions. Barrels suitable for use in the invention are produced by Harbison-Fischer and Scot Industries, among others.

The plunger 30 is a reciprocating plunger connectable to valve rod 22 and may be made of any material suitable for use downhole, including carbon, steel, chrome and spray coated metal and is adapted for use in corrosive and abrasive conditions. It will be appreciated that the plunger 30 may be produced from other materials suited to the particular temperatures, pressures, fluids, and other conditions at the well 14 where in use. The diameter and length of the plunger 30 are variable and depend upon the size of the well 14, the diameter of the casing 16, the size and diameter of the barrel and the amount of production from the well, for example. It will be appreciated that the plunger 30 may be produced from other materials suited to the particular temperatures, pressures, fluids, and other conditions at the well 14 where in use. The diameter and length of the plunger 30 are variable and depend upon the size of the well 14, the size of the barrel 28, and the quantity of production from the well, for example. The length of the plunger 30 generally ranges from at least about 2 to at least about 50 feet, while the diameter of the plunger generally ranges from about 1 inch to about 7 inches. It will be appreciated, however, that the plunger 30 may be any diameter and length suited for conditions at the well where in use. The plunger 30 preferably, though not necessarily, complies with American Petroleum Institute (API) quality standards and dimensions. Plungers suitable for use in the invention are produced by Norris, Harbison-Fischer and Cameron, among others.

Figure 3:
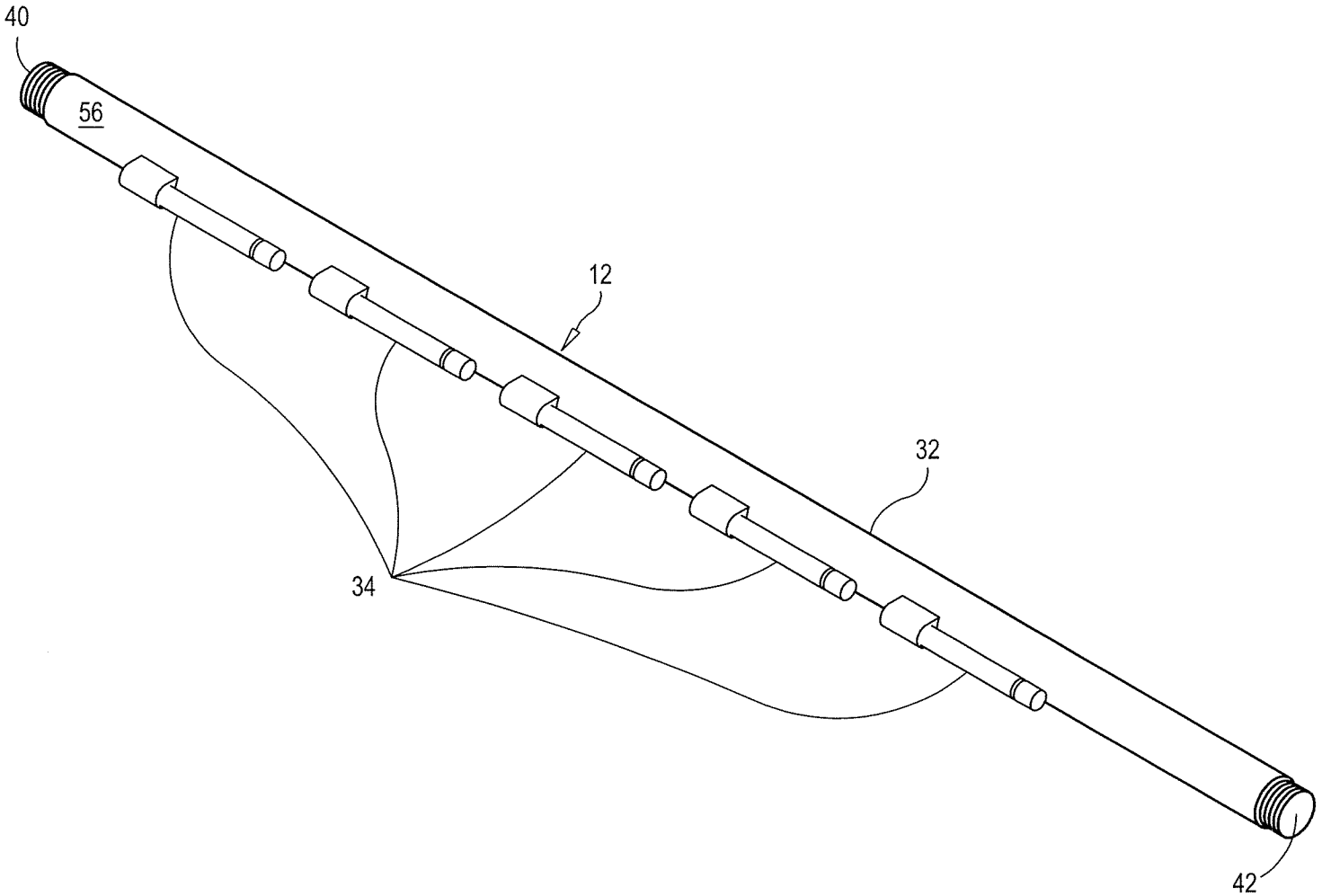
FIG. 3 is a perspective view of the body of an exemplar of the downhole pump of the present invention.

Turning now to FIG. 3, the downhole pump 12 comprises a body 32 connected to tubing string 18. The body 32 comprises at least one valve or a plurality of valves 34 positioned above the barrel 28 and plunger 30 in the well 14. The body 32 may be of any material suitable for use downhole, including steel, chrome, chrome-plated steel, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the body 32 may be produced from other materials suited to the particular temperatures, pressures, fluids, and other conditions at the well 14 where in use. While the shape of body 32 may be any shape configured to fit downhole, a tubular shape generally is preferred as it facilitates operation with other tools and equipment in the well 14. A steel tubing sub is easily adapted and suitable for use in the present invention. A standard pump barrel or other pipe also are adaptable for use in making the body 32 of the present invention.

The diameter and length of the body 32 are variable and depend upon the size of the well 14, the diameter of the casing 16, the size and diameter of the barrel 28 and the plunger 30, the quantity of production from the well, and the number of valves 34, for example. The length of the body 32 generally ranges from at least about 1 foot to at least about 60 feet, while the diameter of the body generally ranges from about 0.5 inches to at least about six feet. It will be appreciated, however, that the body 32 may be any diameter and length suited for conditions at the well where in use. Persons skilled in the art of pumping fluids will know how to size components for the conditions suited to a particular well.

In one embodiment of the invention, body 32 forms threaded ends 40 and 42 and is threadably receivable with couplings 50 and 52, shown in FIGS. 1 and 2. It will appreciated that the ends 40 and 42 of body 32 may be adapted for connection in the well 14 in a variety of ways, other than with threaded couplings. For example, body 32 may form geometric configurations at ends 40 and 42 that receive or are received in alignment with matching geometric configurations in connecting components. Various methods known in the art for connecting components in wells, such as collars, couplings, geometric connections or threaded connections, may be used to connect the body 32 with the barrel 30.

Figure 4:
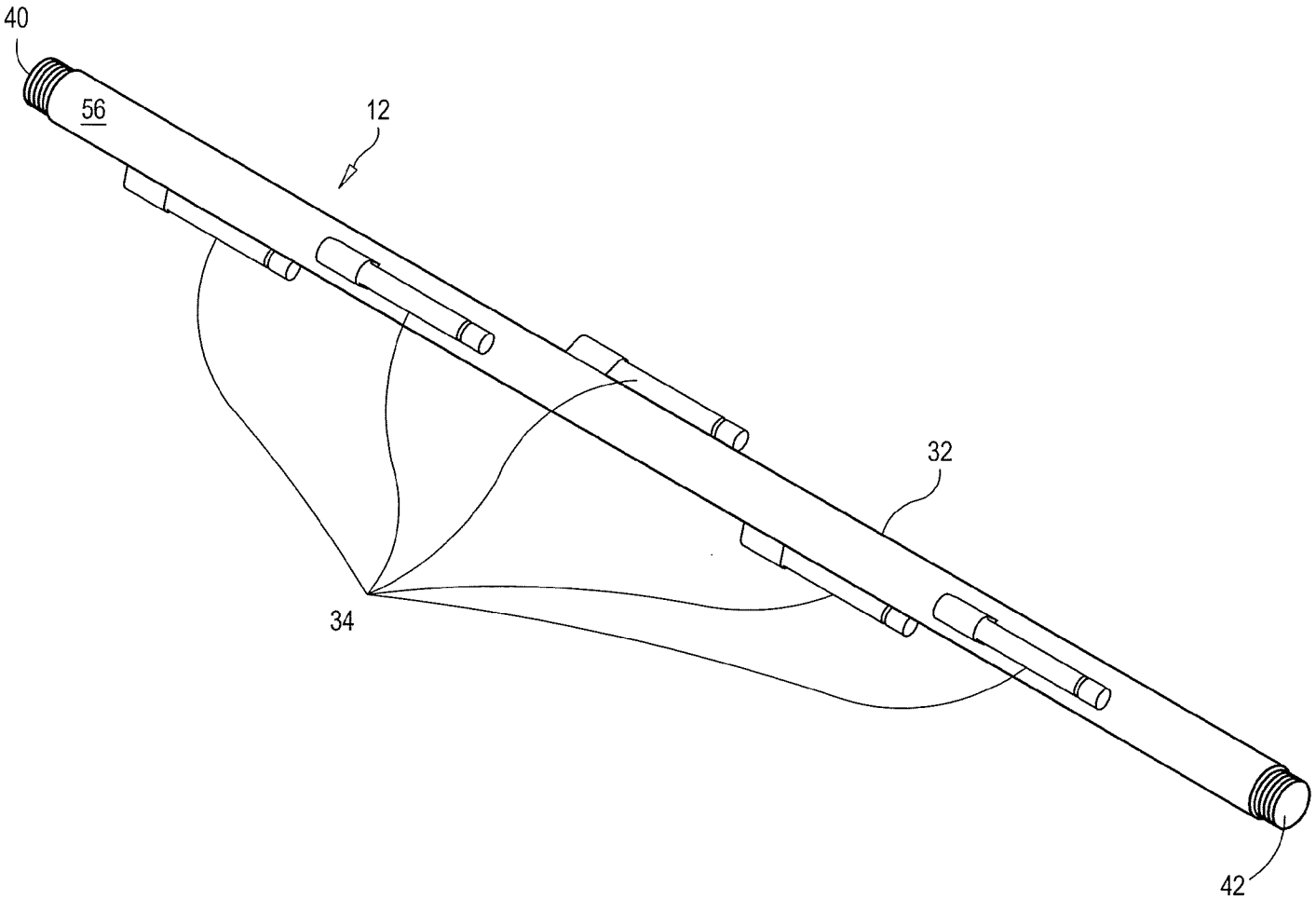
FIG. 4 is a perspective view of the body of an exemplar of the downhole pump of the present invention showing valves in helical arrangement.
Figure 5:
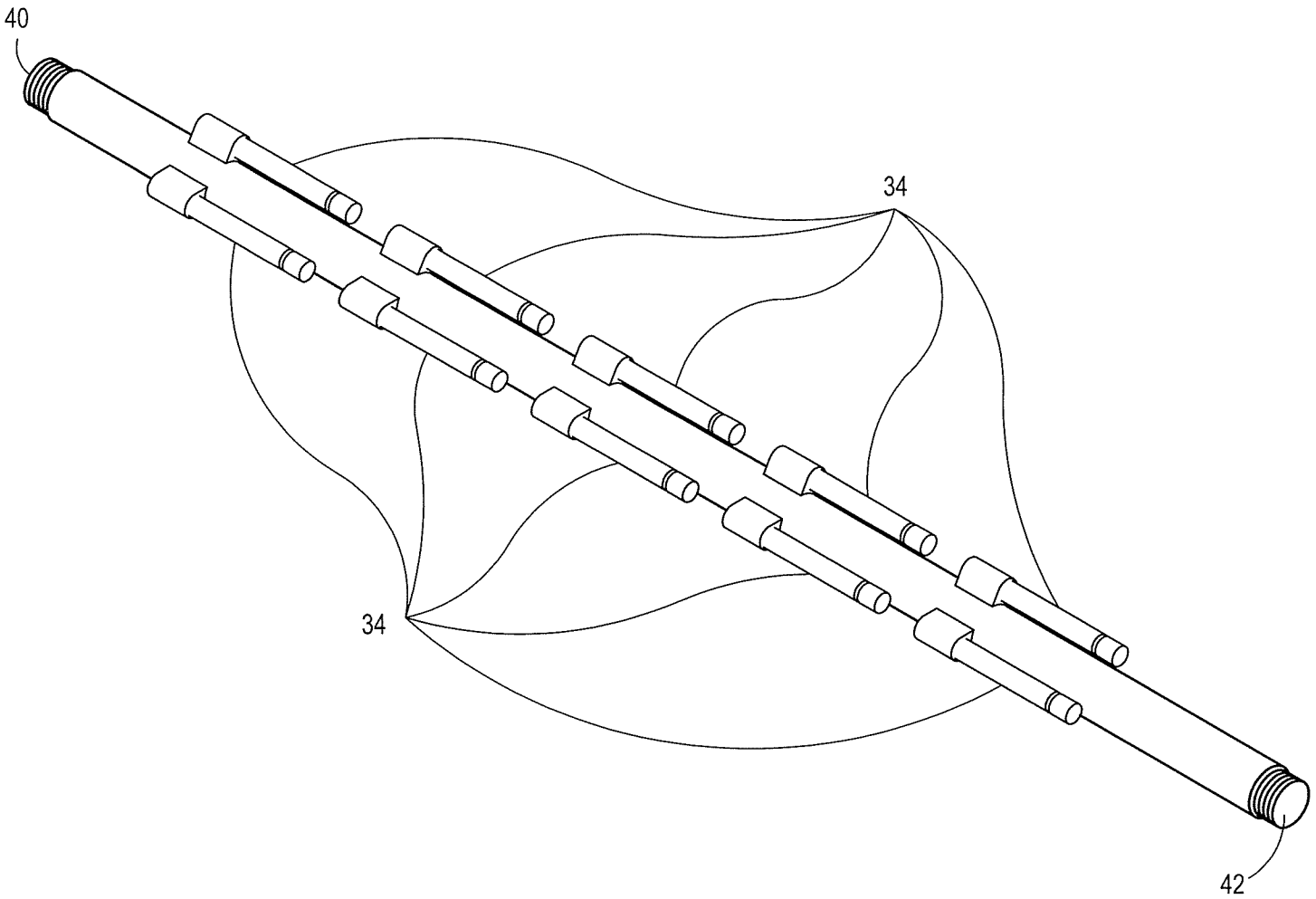
FIG. 5 is a perspective view of the body of an exemplar of the downhole pump of the present invention showing valves in alternating arrangement.
Figure 6:
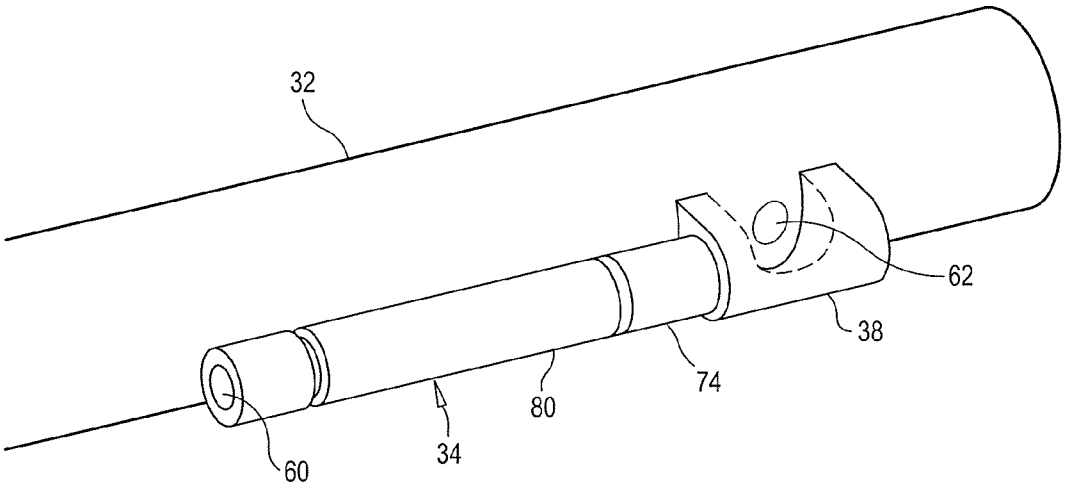
FIG. 6 is a perspective view of an exemplar of a valve suitable for use in the present invention, in partial cutaway.

With continuing reference to FIG. 3, the body 32 forms an exterior surface 56 adapted to receive at least one valve or a plurality of valves 34. It will be appreciated that valves 34 may be positioned on the exterior surface 56 of body 32, or the valves may be at least partially recessed in the body. One advantage of partially recessing the valves 34 in the body 32 is to minimize the overall outer diameter of the body and enables use in smaller wells. The number of valves 34 associated with the body 34 is unlimited. Valves 34 may be situated at any location on body 32. For example, valves 34 may be situated linearly in one side of body 32, as shown in FIG. 3. Alternately, and as additional examples, valves 34 may be positioned helically around the exterior surface 56 of body 32, as shown in FIG. 4, or spaced alternately on opposite sides of the body 32, as shown in FIG. 6. It is important to bear in mind that the number and positioning of valves 34 depends in part on the size of the body 32, the tubing 18 and the casing 14, the productivity of the well, the configuration of the producing earth formation 10 and the location of perforations in the well 14. Positioning valves 34 on one side of the body 32 minimizes the overall outer diameter of the body and enables use in smaller wells, while increasing production, even with smaller equipment and casings.

Valve 34 is connectable to body 32 via connector 38. The connector 38 may be made of any material suitable for use downhole, including steel, chrome, chrome-plated steel, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel and polyvinylchloride. It will be appreciated that the connector 38 may be produced from other materials suited to the particular temperatures, pressures, fluids, and other conditions at the well 14 where in use. While the shape of valve 38 may be any shape configured to fit downhole, a tubular shape generally is preferred as it facilitates operation with other tools and equipment in the well 14.

Connector 38 may be partially recessed in body 32 to enable the valve to sit closely to the exterior surface 58 of the body, creating a smaller overall dimension of the body and enabling use in smaller casing 14. Connector 38 may be welded to body 38, as in one embodiment of the invention, although it will be appreciated that connector 38 may be secured, joined or affixed to body 32 by any known means.

Figure 7:
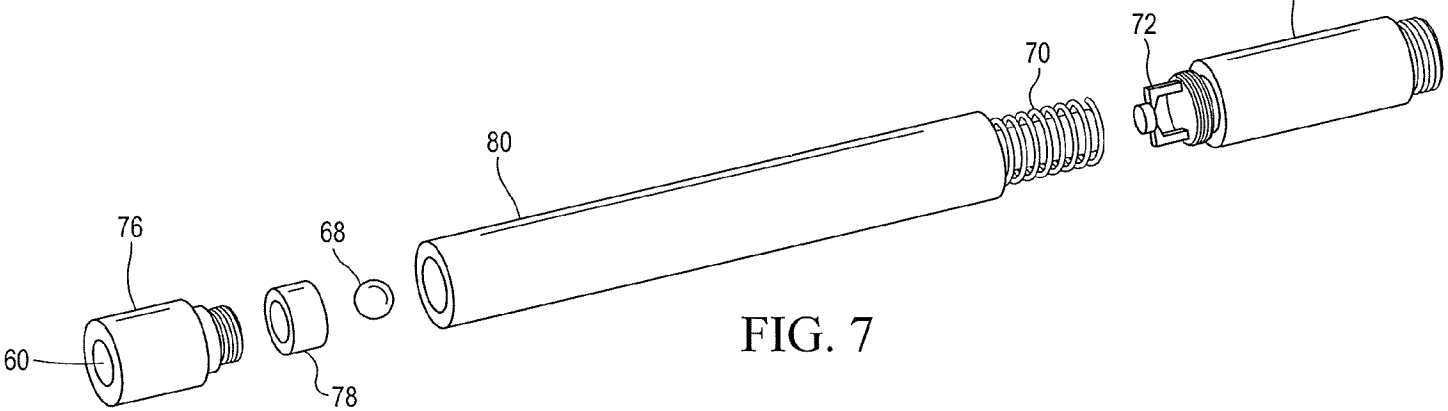
FIG. 7 is an exploded view of the valve shown in FIG. 6.

Turning now to FIGS. 6 and 7, valve 34 is shown secured to body 32 via connector 38 and comprises a first aperture 60 through which fluids enter the valve. Fluids exit valve 34 through connector 38 and enter the body 32 through a second aperture 62 in the body for transport up the tubing string 18 in the direction of arrow x. Valve 34 may be a variety of different types of valves, including ball check valves, diaphragm check valves, swing check valves, tilting disc check valves, stop check valves, lift check valves, and in-line check valves. In one embodiment of the invention, shown in exploded view in FIG. 7, the valve 34 is a ball check valve comprising a ball 68, seated on spring 70, receivable with, in or over seated plug 72. The seated plug 72 is housed in first housing 74, which is receivable in or adapted for connection with connector 38 on body 32. The valve 34 is capped at the opposite end by cap 76, which forms aperture 60, and nut 78, which connect with second housing 80 over ball 68 and spring 70.

In operation of the invention, when the plunger 30 reciprocates up, in the direction of arrow x, fluid moves the ball 68 on top of the seated plug 72. Spring 70 holds ball 68 against seat 72 and seals the off fluid flow into the body 32 through aperture 62. Because the body 32 and valves 34 are positioned above the plunger 30, the upstroke of reciprocating plunger 30 forces fluids to move up through the body 32 into the tubing 18 and to the surface of the well 14 toward the surface equipment or the sales line. On the downstroke of reciprocating plunger 30, the ball 68 is unseated and fluids entering through aperture 60 again may exit the valve 34 and enter the body 32 through aperture 62. It now will be appreciated that valves 34 operate as inlet valves for intaking fluids from well 14 into body 32 and that the unique configuration of pump 12 eliminates the need for outlet valves. Fluids exit the body 32 and enter the tubing string 18 through slide valve 26.

The present invention permits modularity of the components of the pump 12. An operator easily can change out the barrel 28, plunger 30, body 32 or valves 34 when changes in production necessitate modifications in size of components or when maintenance is needed. Only one component need be substituted to alter the production of the well 14.

EXAMPLE

The efficiency of a pump constructed in accordance with the present invention is demonstrated by the following example. An operating well drilled to a depth of at least 7800 feet, was selected that produced 360 bbl/day at 100% efficiency. A pump of the present invention was installed using a 2 inch diameter plunger and a body constructed of 2 and ¾ inch inside diameter tubing sub, 20 feet long, inside a barrel of 2 and ¼ inches diameter. The well was run for a period of 24 hours, during which time the well produced 16.4 bbl/hour using 5 strokes of the plunger per minute. The well produced an additional 31 bbl/day, increasing overall productivity 8.5% to 391 bbl/day and profitability of the well by approximately $3,000 per day.

The present invention further is directed to a method of pumping fluids from a reservoir in a well comprising a tubing string 18. Fluids are drawn in via at least one inlet valve 34 positioned above a plunger 30 within a barrel 28. The fluids move up the tubing string in the direction of arrow x on the upstroke of the plunger 30. The productivity of the well 14 may be altered by changing the plunger 30 to a larger or smaller size, in length, diameter or both, or by changing the size of the barrel, in length, diameter or both. The at least one valve is employed in connection with a body 32 used in association with the barrel 28 and plunger 30. The productivity of the well also may be altered by increasing the number of, or the changing the configuration of, valves 34 employed with body 32 and positioned above the barrel 28 and plunger 30.

The present invention further is directed to a method of preventing gas lock in a well 14 comprising a tubing string 18. To prevent gas lock, fluids are drawn in via at least one inlet valve 34 employed with a body positioned above a plunger 30 within a barrel 28. Fluids enter body 32 through inlet valves 34 and exit the body 32 through slide valve 26 into tubing string 18. The unique configuration of pump 12 eliminates the need for outlet valves.

The unique configuration of pump 12 also eliminates gas lock. Fluids, including gases from the formation 10 or coming out of solution, are forced up the tubing string 18 on the upstroke of the plunger 30. These fluids cannot lock the plunger 30 since the plunger is positioned below the valves 34. Further, the fluids cannot lock the valves 34 since the valves are positioned above the plunger 30 and function as inlets.

It now will be appreciated that the present invention presents a new downhole pump having a unique configuration that places the valves above the plunger and barrel of the pump. This configuration forces fluids up through the tubing string 18 to the surface and prevents gas lock. The configuration is modular and allows easy replacement, maintenance or alteration of the components of the pump, including the barrel, plunger, body or valves. The configuration also increases productivity in a well when using smaller components.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A downhole pump positioned below the tubing string of a well for pumping fluids, the pump comprising:

a body;

at least one valve connectable with the body, wherein the at least one valve comprises a first aperture through which fluids enter the at least one valve and a second aperture through which fluids exit the at least one valve and enter the body; and a plunger moveable between an upper first position and a lower second position, wherein the upper first position is below the at least one valve;

wherein during plunger downstrokes, fluids entering through the first aperture enter the body and wherein during plunger upstrokes, fluids move up the tubing string.

2. The downhole pump of claim 1 wherein the at least one valve is selected from the group consisting of ball check valves, diaphragm check valves, swing check valves, tilting disc check valves, stop check valves, lift check valves, and in-line check valves.

3. The downhole pump of claim 1 wherein the body comprises a steel pipe.

4. The downhole pump of claim 1 wherein the body ranges in diameter from at least about 0.5 inches to at least about six feet in diameter.

5. The downhole pump of claim 1 wherein the body comprises an exterior surface and the at least one valve is at least partially recessed in the exterior surface of the body.

6. The downhole pump of claim 1 further comprising a connector for connecting the at least one valve to the body, the at least one valve being partially recessed in the body.

7. The downhole pump of claim 1 further comprising a barrel and wherein the plunger is positioned inside the barrel.

8. The downhole pump of claim 7, wherein the barrel is modular and the barrel is interchangeable with barrels of alternate size to adjust productivity of the well.

9. The downhole pump of claim 7 wherein the plunger is modular and the plunger is interchangeable with plungers of alternate size to adjust productivity of the well.

10. The downhole pump of claim 1 wherein the at least one valve is modular and is interchangeable with alternate valves.

11. The downhole pump of claim 1 where in the body is modular and is interchangeable with alternate bodies.

12. The downhole pump of claim 1 wherein the at least one valve comprises a plurality of valves that are arranged linearly on one side of the body.

13. The downhole pump of claim 1 wherein the at least one valve consists essentially of an inlet valve.

14. The downhole pump of claim 1 wherein the at least one valve comprises a plurality of valves that are arranged equatorially around the body.

15. A system for pumping fluids in a well having a tubing string, the system comprising:

a pump, the pump comprising a body positioned below the tubing string, a moveable plunger positioned below the body, and at least one valve connectable with the body;

wherein the plunger is moveable between an upper first position and a lower second position, wherein the upper first position is below the at least one valve;

wherein the at least one valve comprises a first aperture through which fluids enter the at least one valve and a second aperture through which fluids exit the at least one valve and enter the body; and wherein during plunger downstrokes, fluids entering through the first aperture enter the body and wherein during plunger upstrokes, fluids move up the tubing string.

16. The system of claim 15 wherein the at least one valve is selected from the group consisting of ball check valves, diaphragm check valves, swing check valves, tilting disc check valves, stop check valves, lift check valves, and in-line check valves.

17. The system of claim 15 wherein the body comprises a steel pipe.

18. The system of claim 15 wherein the body ranges in diameter from at least about 0.5 inches to at least about six feet in diameter.

19. The system of claim 15 wherein the body comprises an exterior surface and the at least one valve is at least partially recessed in the exterior surface of the body.

20. The system of claim 15 further comprising a connector for connecting the at least one valve to the body, the connector being partially recessed in the body.

21. The system of claim 15 further comprising a barrel and wherein the plunger is positioned insider the barrel.

22. The system of claim 21, wherein the barrel is modular and interchangeable with barrels of alternate size to adjust productivity of the well.

23. The system of claim 15 wherein the plunger is modular and interchangeable with plungers of alternate size to adjust productivity of the well.

24. The system of claim 15 wherein the at least one valve is modular and interchangeable with alternate valves.

25. The system of claim 15 wherein the body is modular and in interchangeable with alternate bodies.

26. The system of claim 15 wherein the at least one valve comprises a plurality of valves that are arranged linearly on one side of the body.

27. The system of claim 15 wherein the at least one valve consists essentially of an inlet valve.

28. The system of claim 15 wherein the at least one valve comprises a plurality of valves that are arranged equatorially around the body.

29. A method of pumping fluids from a reservoir via a well comprising a tubing string, the method comprising the steps of:

intaking fluid into a body via at least one inlet valve positioned above a plunger within a barrel; and moving the plunger between an upper first position and a lower second position, wherein the upper first position is below the at least one inlet valve; and moving the fluid up the tubing string on the upstroke of the plunger.

30. The method of claim 29 further comprising the step of adjusting productivity of the well by changing the size of the plunger.

31. The method of claim 29 further comprising the step of adjusting productivity of the well by changing the size of the barrel.

32. The method of claim 29 further comprising the step of adjusting productivity of the well by changing the size of the body.

33. The method of claim 29 further comprising the step of adjusting productivity of the well by changing the size of the barrel.

34. The method of claim 29 further comprising the step of adjusting productivity of the well by altering the number of the at least one inlet valve.

35. The method of claim 29 further comprising the step of adjusting productivity of the well by altering the configuration of the at least one inlet valve.

36. A method of preventing gas lock in a well comprising a tubing string, the method comprising the steps of:

intaking fluid via a valve positioned above a plunger within a barrel; and moving the plunger between an upper first position and a lower second position, wherein the upper first position is below the valve;

discharging fluid from the valve into a body positioned below the tubing string; and moving fluid up the tubing string on the upstroke of the plunger.

37. The method of claim 26 wherein the valve comprises a plug, a first aperture through which fluids enter the valve and a second aperture through which fluids exit the valve and enter the body, and wherein during plunger downstrokes, fluids entering through the first aperture unseat the plug and enter the body and wherein during plunger upstrokes, fluids seat the plug and are forced from the body up the tubing string, thereby preventing gas lock.

38. A component for use with a plunger in a tubing string of a well for pumping fluids, the plunger moveable between an upper first position below the component and a lower second position below the component, the component comprising:

a body; and at least one valve connectable with the body, wherein the at least one valve comprises a first aperture through which fluids enter the at least one valve and a second aperture through which fluids exit the at least one valve and enter the body.

39. The component of claim 38 further wherein the plunger comprises a reciprocating plunger positioned below the component in the tubing string, wherein during plunger downstrokes, fluids enter the component and wherein during plunger upstrokes, fluids are forced from the component up the tubing string.

40. The component of claim 38 wherein the at least one valve is selected from the group consisting of ball check valves, diaphragm check valves, swing check valves, tilting disc check valves, stop check valves, lift check valves, and in-line check valves.

41. The component of claim 38 wherein the component comprises a steel pipe.

42. The component of claim 38 wherein the component ranges in diameter from at least about 0.5 inches to at least about six feet in diameter.

43. The component of claim 38 further comprising an exterior surface, wherein the at least one valve is at least partially recessed in the exterior surface of the component.

44. The component of claim 38 wherein the at least one valve further comprises a connector for connecting the at least one valve to the component, the connector being partially recessed in the component.

45. The component of claim 38, further comprising a barrel, wherein the barrel is modular and the barrel is interchangeable with barrels of alternate size to adjust productivity of the well.

46. The component of claim 38 wherein the plunger is modular and the plunger is interchangeable with plungers of alternate size to adjust productivity of the well.

47. The component of claim 38 wherein the at least one valve is modular and is interchangeable with alternate valves.

48. The component of claim 38 where in the component is modular and is interchangeable with alternate components.

49. The component of claim 38 wherein the at least one valve comprises a plurality of valves that are arranged linearly on one side of the body.

50. The component of claim 38 wherein the at least one valve consists essentially of an inlet valve.

51. The component of claim 38 wherein the at least one valve comprises a plurality of valves that are arranged equatorially around the body.

52. A downhole pump positioned below the tubing string of a well for pumping fluids, the pump comprising:

a body;

a barrel positioned below the body;

a moveable plunger positioned within the barrel and below the body, wherein the plunger is moveable between an upper first position and a lower second position, wherein the upper first position is below the at least one valve; and at least one valve connectable with the body, wherein the at least one valve comprises a plug, a first aperture through which fluids enter the valve and a second aperture through which fluids exit the valve and enter the body;

wherein during plunger downstrokes, fluids entering through the first aperture open the plug and enter the body and wherein during plunger upstrokes, fluids close the plug and are forced from the body up the tubing string.

* * * * *